US005096239A

United States Patent [19]

Rippberger et al.

[11] Patent Number: 5,096,239

[45] Date of Patent: Mar. 17, 1992

[54] DOOR LATCH MECHANISM FOR SOFT-SIDED VEHICLE DOOR

[75] Inventors: Gary R. Rippberger, Denver; Thomas E. Swanson, Boulder, both of Colo.

[73] Assignee: Kayline Manufacturing, Inc., Denver, Colo.

[21] Appl. No.: 605,112

[22] Filed: Oct. 26, 1990

[51] Int. Cl.[5] ..... E05C 3/10

[52] U.S. Cl. ..... 292/128; 292/DIG. 53

[58] Field of Search ..... 292/128, DIG. 31, DIG. 68, 292/121, 219, 228, 130, 136

[56] References Cited

U.S. PATENT DOCUMENTS

| | | | |
|---|---|---|---|
| 1,047,091 | 12/1912 | Larsen et al. | 292/228 |
| 1,120,943 | 12/1914 | Kirn | 292/228 |
| 1,128,502 | 2/1915 | Pinnow | 292/128 |
| 1,170,863 | 2/1916 | Ackerman | 292/128 |
| 1,539,173 | 5/1925 | Fairbank | 292/228 X |
| 1,642,612 | 9/1927 | Haarberg . | |
| 2,387,187 | 10/1945 | Smith | 292/128 X |
| 2,468,353 | 4/1949 | Weinke | 292/228 |
| 3,197,246 | 7/1965 | Russell et al. | 292/128 X |
| 4,420,954 | 12/1983 | Hieronymi et al. | 70/150 |
| 4,451,072 | 4/1984 | Petty, Sr. | 292/128 |
| 4,911,487 | 3/1990 | Rachacki | 242/DIG. 31 X |

*Primary Examiner*—Richard E. Moore

*Attorney, Agent, or Firm*—Fields, Lewis, Pittenger & Rost

[57] ABSTRACT

This invention relates to a door latch for use with a soft-sided door closure in a door opening of a utility vehicle. The latch includes an elongated cup-shaped housing having a back wall, side walls extending forwardly from the back wall and a laterally extending flange extending outwardly around the periphery of the side walls generally parallel to the back wall. The flange includes means for attaching the housing to the door closure and the back wall has a circular opening adjacent one end thereof. An outside door handle member is sized to fit within the length of the housing and has a lever arm formed integrally with a cylindrical body at one end thereof. A sleeve connected to the cylindrical body is extendable through and pivotal in the circular opening. An inside elongated handle member has a length greater than the length of the housing with a handle arm which extends beyond the housing in a forward direction and an offset flange at the opposite end with a releasable locking means formed therein. The inside handle member is fixedly attached to the cylindrical body of the outside handle member for rotation therewith in the circular opening between a latched position and an unlatched position. Spring means is connected to one of the handle members normally urging them toward the latched position. A striker member is mountable on the door opening and positionable to be engaged by the releasable locking means to hold the door closure in closed position when the handle members are in the latched position.

14 Claims, 3 Drawing Sheets

DOOR LATCH MECHANISM FOR SOFT-SIDED VEHICLE DOOR

TECHNICAL FIELD

This invention relates to a door lock mechanism and particularly one for use with a soft-sided vehicle door.

BACKGROUND ART

The design and construction of a door latch for a soft-sided vehicle door presents special problems not inherent in a conventional door having rigid outer and inner panels. In a conventional door, the inside latch member is positioned near the front jamb of the door whereas the outside latch member is positioned near the rear jamb of the door. This requires a linkage between the two handles. In a standard door, this linkage mechanism can be provided between the rigid outer steel panel and the inner door panel where it is out of sight and can be easily mounted. In a soft-sided vehicle door, because of the lack of rigidity, the latch mechanism must be confined to the rear jamb area so that both the inside and outside door handles are at this location and mounted on a mounting plate provided for this purpose. A conventional latch mechanism for use in soft-sided vehicle doors is disclosed in U.S. Pat. No. 4,420,954 to Hieronymi et al. which includes a lever mounted on a vertical pivot on the outside of the door a slide latch on the inside of the door. This device is satisfactory for its intended purpose but the inside slide latch mechanism is difficult to reach because it is in the location of the hip of the vehicle occupant. This requires the occupant to either reach back and blindly fumble for the latch or to turn around to an awkward position to reach the latch. If the occupant is confined by a seat belt this procedure is even more difficult.

Additional prior art which provides inside and outside handle means which are opposite each other are:

U.S. Pat. No. 4,451,072 to Petty, Sr. discloses a vertically pivoted spring bias lever/hook that acts as a latch.

U.S. Pat. No. 1,642,612 to Haarberg discloses a latch with a hook at one end that is spring bias and operates by pushing on the opposite end in a downward motion.

U.S. Pat. No. 2,468,353 to Weinke discloses a spring bias latch accessible from two sides and pivots.

Although each of these latch mechanisms is satisfactory for its intended purpose, none of them are designed for or are practical for use on a soft-sided vehicle door.

DISCLOSURE OF THE INVENTION

In accordance with this invention, a door latch for use with a soft-sided door closure in a door opening of a utility vehicle has been provided. The latch includes an elongated cup-shaped housing having a back wall, side walls extending forwardly from the back wall and a laterally extending flange extending outwardly around the periphery of the side walls generally parallel to the back wall. The flange includes means for attaching the housing to the door closure and the back wall has a circular opening adjacent one end thereof. An outside door handle member is sized to fit within the length of the housing and has a lever arm formed integrally with a cylindrical body at one end thereof. A sleeve connected to the cylindrical body is extendable through and pivotal in the circular opening. An inside elongated handle member has a length greater than the length of the housing with a handle arm which extends beyond the housing in a forward direction and an offset flange at the opposite end with a releasable locking means formed therein. The inside handle member is fixedly attached to the cylindrical body of the outside handle member for rotation therewith in the circular opening between a latched position and an unlatched position. Spring means is connected to one of the handle members normally urging them toward the latched position. A striker member is mountable on the door opening and positionable to be engaged by the releasable locking means to hold the door closure in closed position when the handle members are in the latched position.

Additionally, a generally U-shaped bracket can be provided which extends around the inside handle member and attaches to the housing and provides a mounting for a coil spring which can extend between the bracket and the inside handle member to normally hold the handles in locked position.

In an alternative embodiment, the striker member can be mounted on a bracket attached to a bow for supporting the side walls and roof of the utility vehicle.

Additional advantages of this invention will become apparent from the description which follows, taken in conjunction with the accompanying drawings.

BRIEF DESCRIPTION OF THE INVENTION

BEST MODE FOR CARRYING OUT THE INVENTION

Figure 1:
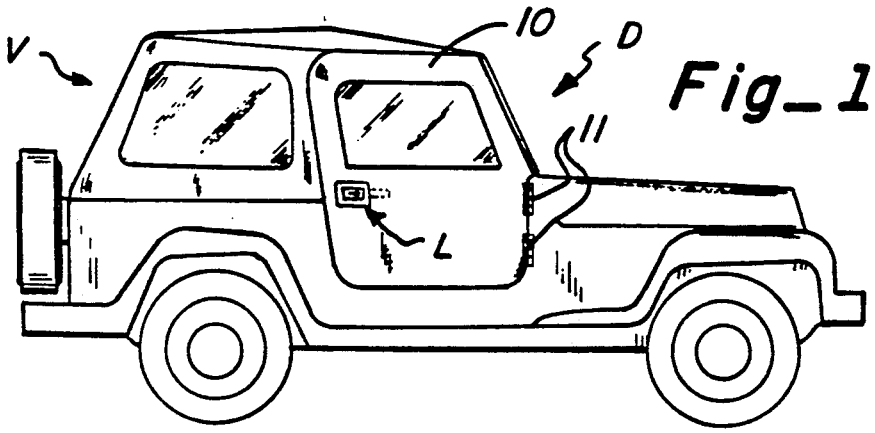
FIG. 1 is a side elevation of a utility vehicle utilizing the door closure of this invention.
Figure 8:
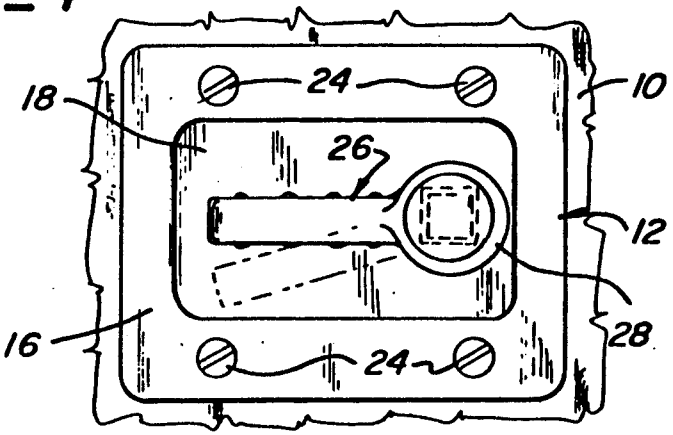
FIG. 8 is a outside side elevation, on a reduced scale, showing the outside door handle.
Figure 5:
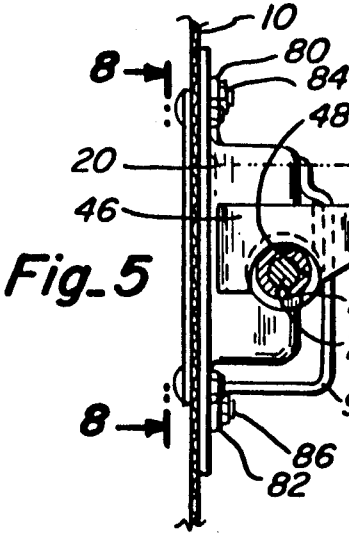
FIG. 5 is a vertical section, taken along line 5—5, showing the latching engagement of the latching means and striker member.
Figure 7:
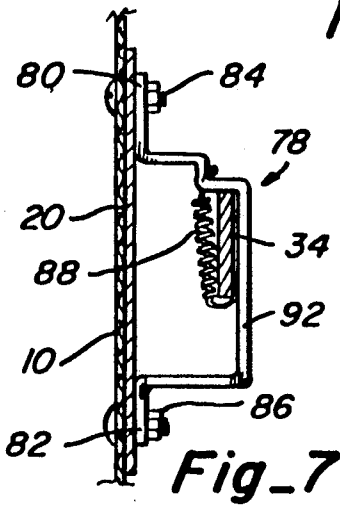
FIG. 7 is a vertical section, taken along line 7—7 of FIG. 4, showing the attachment for the spring mechanism for holding the latch mechanism in closed position.
Figure 6:
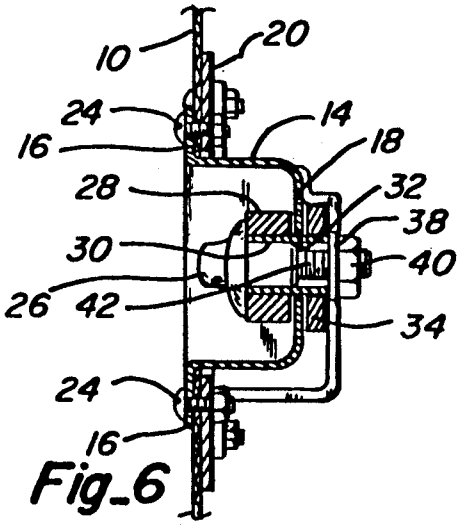
FIG. 6 is a vertical section, taken along line 6—6 of FIG. 4, showing details of the pivotal mechanism for the latch.

As seen in FIG. 1, a utility vehicle V, such as a Jeep, is provided with a soft top which includes a soft-sided door closure D, having a rigid frame covered with fabric, which is releasably held in closed position by a latch mechanism L. The door closure D includes a soft panel 10 made of fabric and is mounted for swinging movement about hinges 11. Panel 10 has an opening therein for receiving a housing 12. The housing is an elongated cup-shaped member having a peripheral side wall 14 with an outwardly extending flange 16 and a back wall 18. Conveniently, a generally rectangular plate 20 is provided on the inside of panel 10 which has a central opening 22 through which housing 12 extends, as shown. The housing and plate are held in place by spaced bolts 24 around the periphery of opening 22. Outside handle 26 is sized to be received within housing 12 and has a cylindrical member 28 formed at one end thereof and has a rectangular coupler which extends through circular opening 32 in back wall 18 of housing 12. Thus, by depressing outside handle 26, as shown in dotted lines in FIG. 8, the corner edges of coupler 30 which engage the surface of opening 32 will rotate therein. An inside handle 34 is provided which is of a greater length than housing 12 and has a rectangular opening 36 which is received over coupler 30 and held in place by means of a washer 38 and nut 40 which are received over the end of bolt 42 extending through the center of cylindrical member 28. Thus, when outside handle 26 is rotated, inside handle 34 will rotate with it, and visa versa. Inside handle 34 is provided with a grip or cover 44 at the forward end for grasping and manipulating the handle. The opposite end is provided with an offset flange 46 having a recess 48 in the lower edge thereof.

Figure 2:
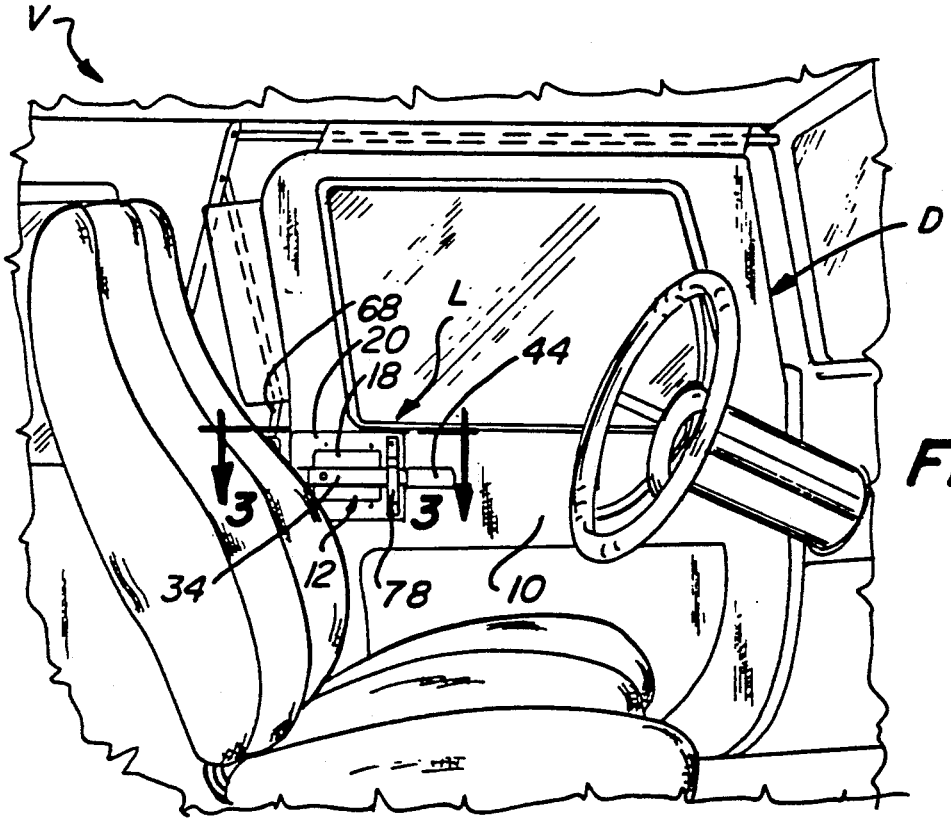
FIG. 2 is a view from within the vehicle showing the soft-sided door utilizing the door closure of this invention.
Figure 3:
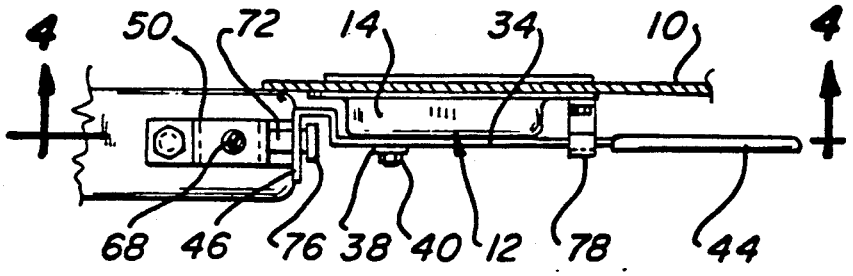
FIG. 3 is an enlarged horizontal section, taken along line 3—3 of FIG. 2, showing further details of the door closure.
Figure 9:
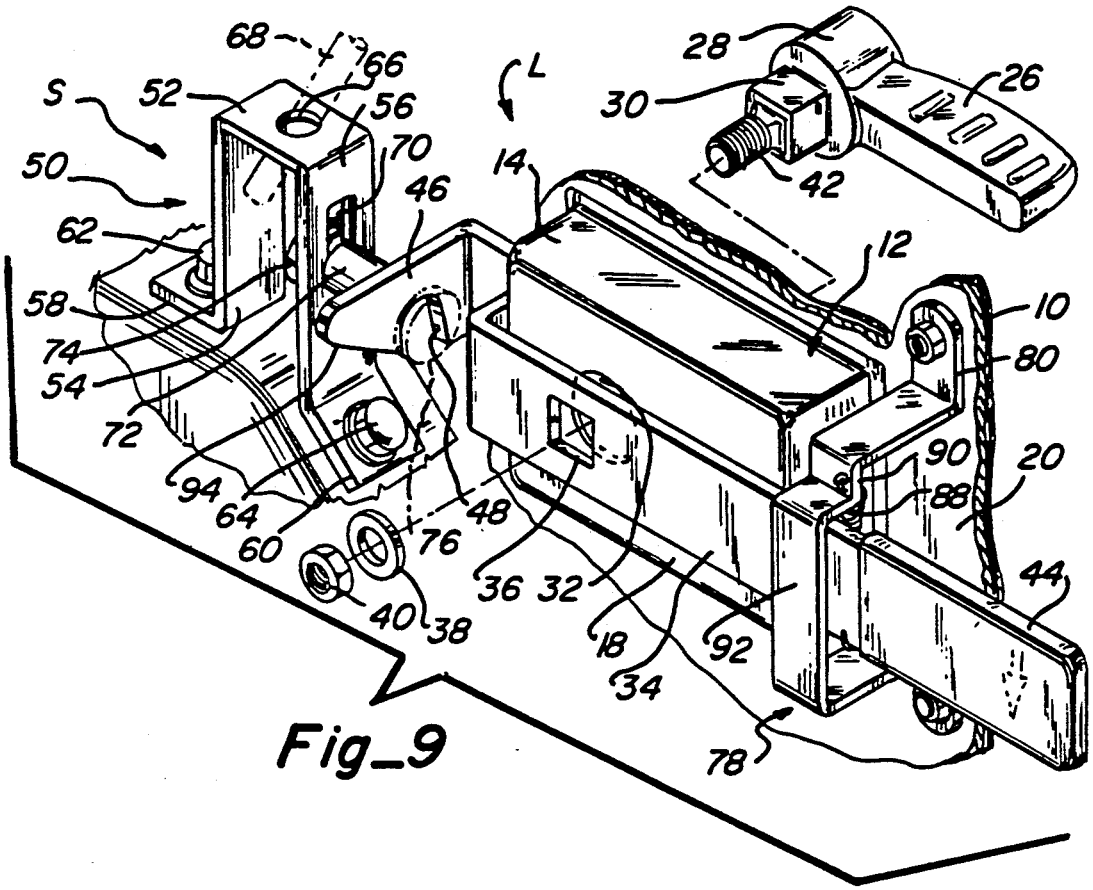
FIG. 9 is an isometric exploded view of the latch mechanism of this invention.

A striker member S is mounted on the vehicle body adjacent the door opening and includes a generally U-shaped bracket 50 having a horizontal portion 52 supported by vertical legs 54 and 56, respectively, depending from opposite ends thereof. Conveniently, the lower end of leg 54 terminates in an outwardly extending flange 58 and the lower end of leg 56 terminates in an outwardly and downwardly extending flange 60. These flanges are attached to the vehicle body by means of bolts 62 and 64, respectively. As best seen in FIG. 9, an opening 66 is provided in horizontal portion 52 for receiving a strut 68 which supports a portion of the flexible side wall of the vehicle, as shown in FIG. 2. Leg 56 is provided with a vertical slot 70 for adjustably supporting cylindrical latch member 72. Latch member 72 has a threaded bolt 74 which extends through the center thereof and is adjustably positioned along slot 90 so that the recess 48 properly engages latch member 72. Advantageously, the end of latch member 72 is provided with a flange or collar 76 to help assure that once the door is closed, the latch member will not inadvertently become separated.

Figure 4:
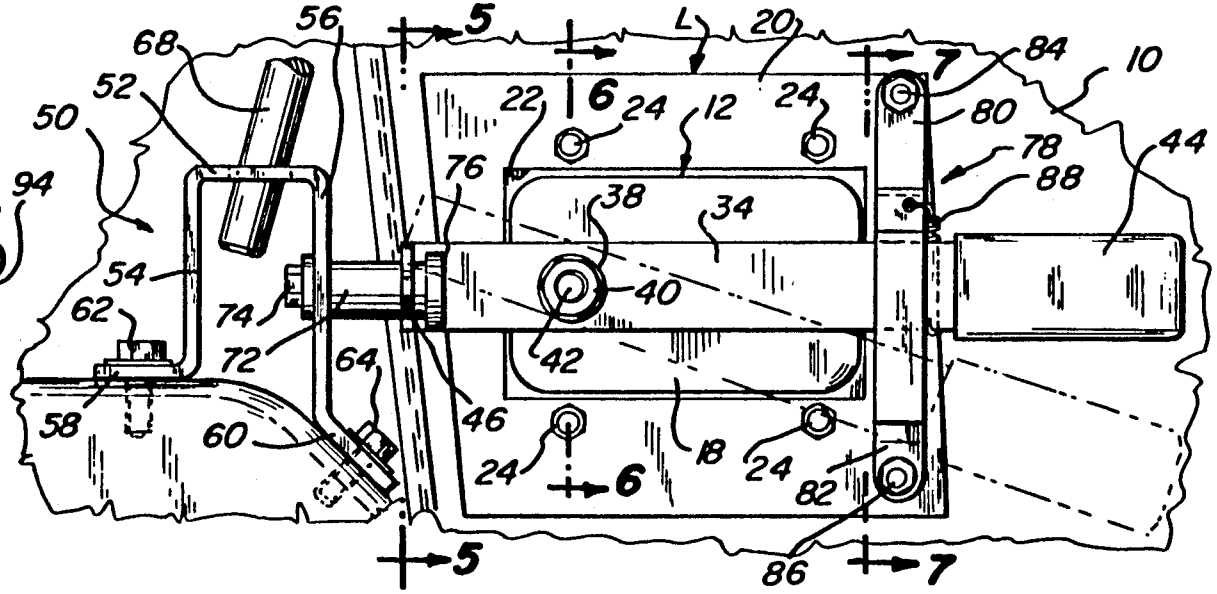
FIG. 4 is an enlarged fragmentary side elevation of the inside of the latch mechanism for the door closure of this invention.

Conveniently, a generally U-shaped bracket 78 extends around inside door handle 34 intermediate its ends, as best seen in FIGS. 4 and 9 and has outwardly extending flanges 80 and 82, respectively, which are attached to plate 20 by means of bolts 84 and 86, respectively. In order to maintain the latch mechanism L in latched position, a coil spring 88 is provided which has one end attached to inside handle 34 and the other end is attached to an offset 90 in bracket 78. The vertical segment 92 of bracket 78 is of sufficient length to allow inside door handle 34 to pivot from the horizontal latched position shown in FIG. 4 to the pivoted unlatched position shown in dotted lines. In addition, offset flange 46 is provided with a sloping edge 94 which will ride up across latch member 72 as the door is closed forcing the handle 34 to be pivoted in a clockwise direction as viewed in FIGS. 4 and 9 so that recess 48 becomes engaged with latch member 72.

Figure 10:
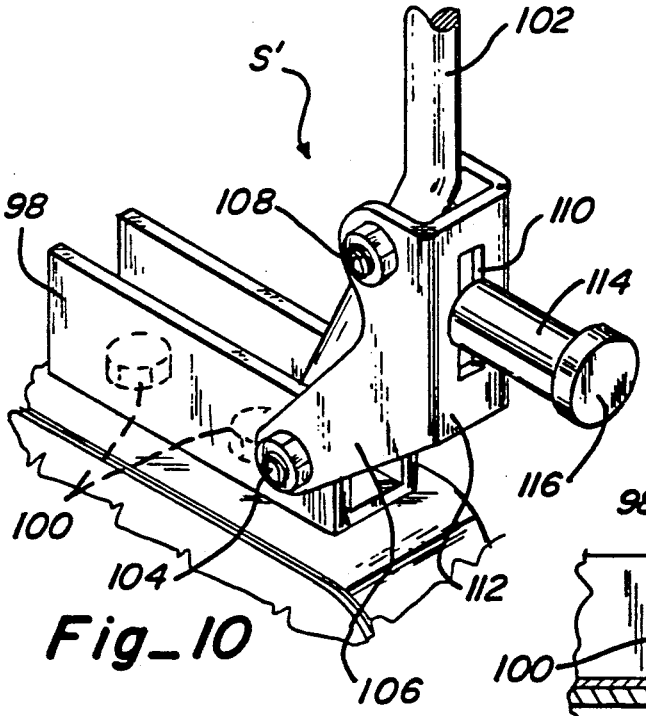
FIG. 10 is a perspective view of an alternative mounting striker mechanism.
Figure 11:
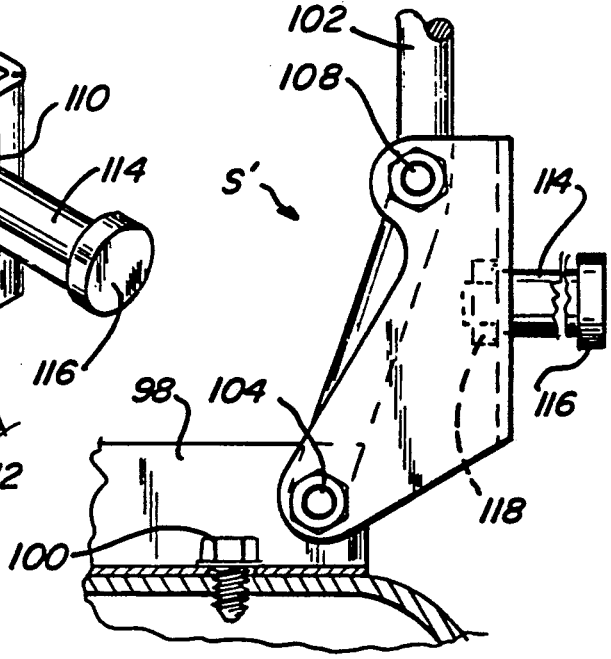
FIG. 11 is a side elevation of the striker mechanism of FIG. 10.

An alternative structure for the striker S' is shown in FIGS. 10 and 11. In this embodiment, a channel member 98 is connected to the vehicle body by means of screws 100 and has one end of a bow 102 pivoted thereto by means of a pivot pin 104. The bow supports the flexible, convertible top of the vehicle for raising and lowering it and holding it in position. A bracket 106 also is attached to pivot pin 104 and is connected to the bow by means of a pin 108. Bracket 106 is provided with a slot 110 in vertical wall 112 for vertical adjustment of a cylindrical latch member 114 which has a flange 116 at the outer end thereof. In operation, latch member 114 and flange 116 operate in the same manner as latch member 72 and flange 76 of the previously described embodiment. Conveniently, latch member 114 is adjustably held in place by means of bolt 118, shown in FIG. 11.

From the foregoing, the advantages of this invention are readily apparent. A door latch of simple construction has been provided for use on a utility vehicle wherein the inside door handle is of sufficient length and has a grip positioned so that it can be easily seen by the occupant of the vehicle and grasped in order to unlatch the door. This is accomplished by still maintaining the latch mechanism near the rear jamb of the door so that the outside handle is positioned near the jamb of the door, as is most desirable. The striker member is connected to the vehicle and provides support for the flexible vehicle top, thereby providing a dual function.

This invention has been described in detail with reference to particular embodiments thereof, but it will be understood that various other modifications can be effected within the spirit and scope of this invention.

We claim:

1. A door closure for a door opening in a utility vehicle having a soft top, said door closure comprising:

a door covered with fabric and having an outer side, an inner side, first side edge with hinges for mounting the closure for swinging movement between open and closed positions and a second side edge opposite said first side edge;

an opening in said fabric adjacent said second side edge;

a housing mounted in said opening having a generally rectangular cup-like configuration open to the outer side, said housing having an elongated body portion extending inwardly beyond the inner side of the fabric, said body portion having a first end adjacent said second edge and said door frame and a second end spaced therefrom and a vertical rear wall generally parallel to the plane of said fabric, said vertical wall having a circular opening therein adjacent said first end of said body portion;

an outside handle positioned within said housing, said handle having a coupler extending through said circular opening mounted for pivotal movement therein and a lever arm extending from said cylindrical member toward said second end of said housing for pivoting said handle; and an inside elongated handle located inside said vertical rear wall of said housing, said inside handle being fixedly connected to said coupler intermediate the ends of said inside handle so that said outside handle and said inside handle pivot together, said inside handle having a forwardly extending lever arm for turning said inside handle to open said door closure and having latch means at its rear end for latching said door closure in closed position.

2. Apparatus, as claimed in claim 1, wherein:

said coupler is rectangular and has side edges which engage and rotate about the surface of said opening when said handles are rotated.

3. Apparatus, as claimed in claim 1, further including:
resilient means attached to said inside handle to return said handles to locked position.

4. Apparatus, as claimed in claim 2, further including:
a mounting plate on the inside of said fabric opening; and
fastening means extending through the fabric to secure said housing to said mounting plate.

5. Apparatus, as claimed in claim 4, further including:
a retainer bracket extending around said inside handle and fixedly attached to said mounting plate, said resilient means connected between said inside handle and said bracket to return said handles to latched position.

6. Apparatus, as claimed in claim 5, wherein:
said resilient means is a coil spring.

7. Apparatus, as claimed in claim 1, further including:
a latch member attachable to the door opening for releasably receiving said latch means to latch said door closure in closed position.

8. Apparatus, as claimed in claim 7, wherein:
said latch means includes an inwardly extending flange with a recess in the lower edge thereof; and
said latch member includes a cylindrical member which lies along an axis which is generally parallel to said door closure when in the closed position and is positioned to be engaged by said recess of said latch means to hold said door closure in closed position.

9. Apparatus, as claimed in claim 8, wherein said latch member further includes:
a collar adjacent the end of said cylindrical member which is positioned behind said inwardly extending flange when the door closure is in closed position.

10. A door latch for use with a soft-sided door closure for a door opening in a utility vehicle, said latch comprising:
an elongated cup-shaped housing having a back wall, side walls extending forwardly from said back wall and a laterally extending flange extending outwardly around the periphery of said side walls generally parallel to said back wall, said flange including means for attaching said housing to said door closure and said back wall having a circular opening adjacent one end thereof;
an outside handle member being sized to fit id housing having a lever arm having a coupler attached to and extending perpendicularly from one end thereof and being extendable through and pivotal in said circular opening;
an inside elongated handle member having a length greater than the length of said housing with a handle arm extending beyond said housing and an offset flange at the opposite end with releasable locking means, said inside handle member being fixedly attached to said coupler for rotation therewith in said circular opening between a latched position and an unlatched position;
spring means connected to one of said handle members normally urging them toward said latched position; and
a striker member mountable in the door opening and positionable to be engaged by said releasable locking means to hold the door closure in closed position when the handle members are in said latched position.

11. Apparatus, as claimed in claim 10, further including:
a mounting plate on the inside of said door closure; and
fastening means connecting said flange to said plate through said door closure.

12. Apparatus, as claimed in claim 11, further including:
a bracket attached to said panel and extending around said handle arm; and
said spring means being a coil spring connected between said handle arm and said bracket.

13. Apparatus, as claimed in claim 10, wherein:
said releasable locking means is a recess in the edge of said offset flange; and
said striker member includes a member which is releasably received in said recess to hold the door closure in closed position.

14. Apparatus, as claimed in claim 13, wherein:
said recess is in the lower edge of said offset flange; and
said member is cylindrical and has a collar adjacent the distal end thereof to engage said offset flange when said handle members are in said latched position.

* * * * *

UNITED STATES PATENT AND TRADEMARK OFFICE

CERTIFICATE OF CORRECTION

PATENT NO. : 5,096,239

DATED : March 17, 1992

INVENTOR(S) : Gary R. Rippberger and Thomas E. Swanson

It is certified that error appears in the above-identified patent and that said Letters Patent is hereby corrected as shown below:

Column 5, Line 46, after "fit" insert --within the length of said--;

Column 6, Line 1, delete "id".

Signed and Sealed this

Thirteenth Day of July, 1993

*Attest:*

*Attesting Officer*

Michael K. Kirk

MICHAEL K. KIRK

*Acting Commissioner of Patents and Trademarks*